US005462134A

United States Patent [19]

Van Helmond

[11] Patent Number: 5,462,134

[45] Date of Patent: Oct. 31, 1995

[54] SCAFFOLDING CONSTRUCTION, IN PARTICULAR MEANS FOR JOINING TWO OR MORE OF ITS POSTS IN VERTICAL POSITION

[75] Inventor: Johannes H. M. Van Helmond, Helmond, Netherlands

[73] Assignee: SGB Holdings Ltd. for These Research & Development Dept. Holland, Venray, Netherlands

[21] Appl. No.: 166,024

[22] Filed: Dec. 14, 1993

[30] Foreign Application Priority Data

Dec. 28, 1992 [NL] Netherlands ..... 9202269

[51] Int. Cl.[6] ..... E04G 1/14

[52] U.S. Cl. ..... 182/178; 403/306

[58] Field of Search ..... 182/178, 179; 403/12–14, 305, 306; 52/638, 637

[56] References Cited

U.S. PATENT DOCUMENTS

| | | | |
|---|---|---|---|
| 540,834 | 6/1895 | Gumm | 403/305 X |
| 2,988,318 | 6/1961 | Ferguson | 403/305 X |
| 3,885,648 | 5/1975 | Beziat | 182/178 |
| 4,430,839 | 2/1984 | Butters | 182/176 |
| 4,802,752 | 2/1989 | Anglin | 403/305 X |

FOREIGN PATENT DOCUMENTS

| | | | |
|---|---|---|---|
| 2143700 | 8/1979 | Germany | 182/178 |
| 671814 | 9/1989 | Switzerland . | |
| 799295 | 7/1957 | United Kingdom . | |
| 788601 | 1/1958 | United Kingdom | 182/178 |
| 1090185 | 11/1967 | United Kingdom | 182/178 |

*Primary Examiner*—Alvin C. Chin-Shue
*Attorney, Agent, or Firm*—Foley & Lardner

[57] ABSTRACT

A scaffolding construction used particularly for H-shaped frames. The posts of a frame are provided at one end with a bushing, of which the inner diameter is larger than the outer diameter of the post (1). The bushing is provided with a recess and a staggered groove lying opposite to the recess. The end of another post is provided with a pin (14) which can be fittingly received through the groove and recess (7) in bushing (5). During assembly the post is placed in a position, such that its pins (14) are inserted through the groove via the recesses. During the angular rotation of the post into its vertical position, the pins are guided by the grooves and supported by the recesses, so that the pins come to rest in the posts.

17 Claims, 2 Drawing Sheets

SCAFFOLDING CONSTRUCTION, IN PARTICULAR MEANS FOR JOINING TWO OR MORE OF ITS POSTS IN VERTICAL POSITION

BACKGROUND OF THE INVENTION

The invention relates to a scaffolding construction, and in particular, to the means which allow two or more posts thereof to be joined together in a vertical position.

In the known constructions, said means are, for example, formed through the provision of a member at the lower end of a post, that can be received in the upper end of the underlying post.

That is, a post must first be placed in a vertical position above a preceding post. Because there are no lifting means available in most cases, this forms a heavy physical strain on those who build up the scaffolding. This is also caused through the scaffolding elements usually being formed of steel because of costs and strength, and which therefore are heavy.

Furthermore, in most cases the position in the known constructions at which the posts are joined together, will be located at the level of a platform, since otherwise the next post cannot, or can only with difficulty, be brought into a vertical position above the preceding post. That is to say, as long as a following post has not been placed on the preceding one, the platform cannot be provided with rests. This makes the assembly of the scaffolding less safe.

SUMMARY OF THE INVENTION

The purpose of the invention is the removal of these objections, and to that end, it provides a post at one end, which end forms the upper end of the post in the assembled construction, provided with a bushing, of which the inner diameter is larger than the outer diameter of a post and of which a portion protudes beyond the end of the post, which protuding end is provided with a recess open at the top, which extends along a part of the circumference of the bushing, and with a groove in the wall portion of the bushing lying opposite the recess, such that the groove, as viewed in the longitudinal direction of the post, is staggered relative to the recess and the outermost end lies between the ends of the recess lying opposite, while the lower end of a post is provided with a pin which can be fittingly received in the groove and in a portion of the upper end of a post, whereby the groove in the bushing proceeds so far towards the end of the post, that the pin mounted in the groove, of a horizontally positioned post supported by the recess, is guided by the vertical walls of the groove during part of the angular rotation which the post carries out during its swinging into the vertical position, while a portion of the post is supported by the lower edge of the recess.

During assembly, a post is brought into the horizontal position and moved in this direction, such that its pin falls into the groove and can come to rest in the recess. Following this, the post can be swung into the vertical position. Due to the weight of the post, its pin will lower automatically and move through the groove towards the upper end of the underlying post, and finally be received in there.

Thus, a kind of hinge is formed between both posts, but without a fixed joint being present between the posts. Since the post to be assembled first can be brought into the horizontal position in the bushing of the preceding post, the bushing can be located at some distance above a platform.

It is therefore possible to provide the platform directly with rests, so that the placing of the next post can be conducted safely.

For limiting the width of the groove, it can be provided that the pin connected to the end of a post possess a square cross-section. Then, the width of the groove is required to be only slightly larger than the size of a side of the square. The wall thickness of the bushing, and therefore its production cost, can therefore be kept as low as possible.

In using a pin with a square cross-section, it can be received more easily in a preceding post with a circular cross-section, than in the case in which the pin possess a circular cross-section.

For optimum guidance of a post during its being swung from the horizontal position to the vertical position, the inner diameter of the bushing can be provided to be larger than the outer diameter of the post, and that the recess extends over less than half the circumference, and the width of the recess is sufficient for letting a post pass.

The post swinging upwardly therefore experiences a better support in the direction perpendicular to the plane in which the post is being moved.

Furthermore, it is achieved that the bushing is weakened as little as possible where the recess and the groove lie opposite to each other. It is also because of this that, the wall thickness of the bushing can be kept limited.

The manufacturing of the bushing can be simplified because the groove extends till the other end of the bushing. Since the lower edge of the bushing is welded to the post, or fixed to it in another fashion, no deformation of the bushing will occur.

To prevent a post in vertical position being pulled out of the underlying post, a locking pin can be used, which can be inserted in bores-in-line in a pin joined to a post and the portion of the post in which the pin can be received.

A rapid construction of a scaffolding according to the invention can be achieved when two parallel and spaced posts are joined together by at least one cross beam extending across the posts, such that a substantially H-shaped frame is obtained. The pins of the two posts of such a frame can then be inserted simultaneously in the grooves of the bushings of a frame that has been positioned previously, after which the frame can be swung into the vertical position.

It is to be noted that as such more or less H-shaped frames are known. However, a disadvantage of these known frames is that they are susceptible to damage or deformation, which leads to the distance between centrelines of the posts not being fixed. This causes an obstruction during the assemblying of the frames. In using the pin and the bushing according to the present invention, one obtains the advantage that both pins of a frame still can be simply inserted in horizontal position in the bushings of an underlying frame, even with relatively large deviations with respect to the nominal distance between centrelines of the posts. In swinging the uppermost frame upwardly, it will easily lower down towards the lowermost frame due to its own weight as a result of the elastic deformation capacity.

BRIEF DESCRIPTION OF THE INVENTION

The invention is further specified with an embodiment, illustrated in the drawings, in which.

DESCRIPTION OF THE PREFERRED EMBODIMENT

Figure 1:
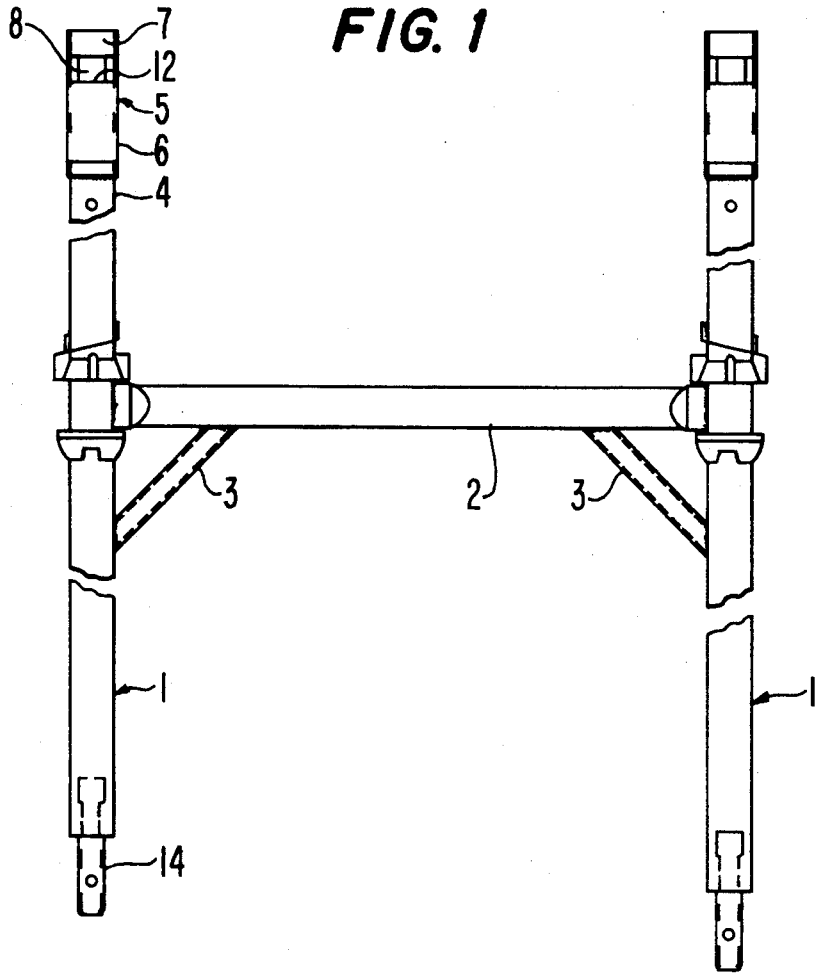
FIG. 1 depicts a view of a frame according to the present invention.
Figure 2:
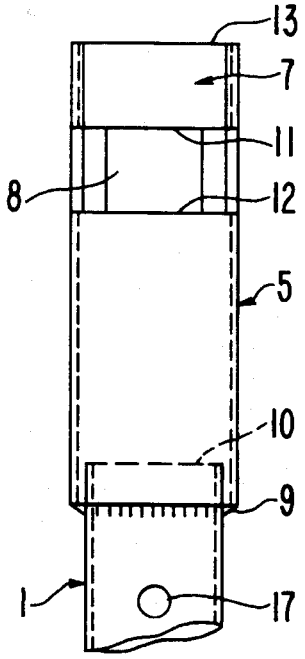
FIG. 2 depicts an enlarged view of a detail of the upper end of a post of the frame of FIG. 1.

FIG. 1 illustrates a frame comprising posts 1, which are joined together by a cross beam 2 and a strut 3. Means, not shown in detail, can be present at the cross beam for the joining of rests or other construction elements to the posts. Such elements can also be provided at other locations on the posts, such as for the assemblying of platforms.

As indicated in particular in FIGS. 2 to 5, the upper end 4 of a post 1 is provided with a bushing 5, of which portion 6 extends beyond the end of the post. This end 6 is provided with a recess 7 open at its upper end and being limited by the wall 12 at its lower end or bottom. Further, the bushing 5 is provided with a groove 8 lying opposite to the recess 7 and extending vertically. At the upper end the groove 8 is limited by the wall 11 and at the lower end by the wall 10, being the upper end of the post 1.

Figure 6:
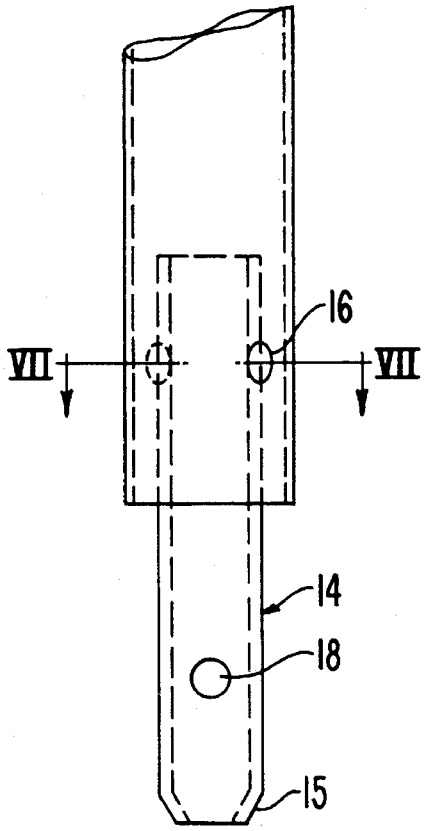
FIG. 6 depicts an enlarged view of a detail of the lower end of a post of the frame of FIG. 1.
Figure 7:
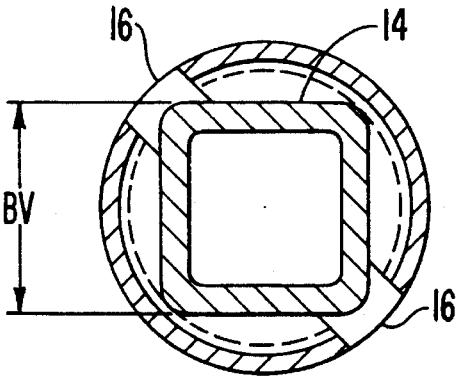
FIG. 7 depicts a cross-section along the line VII—VII of FIG. 6.

As apparent in particular from FIGS. 1, 6 and 7, the lower edge of a post 1 is provided with a pin 14, with a square cross-section and with a bevelled end portion 15. The pin 14 can be formed of a tubing member, and it is fixed in the post by means of the weldings 16. Of course, another method of joining the pin to the post can also be used.

Figure 5:
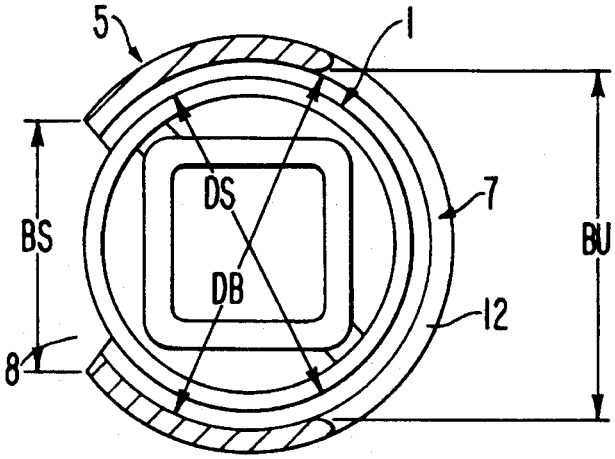

The inner diameter DB of the bushing 5 is slightly larger than the outer diameter DS of the post 1, as indicated in FIG. 5. Because of this, the width BU of the recess 7 can be slightly larger than the diameter DS of the post 1, while the recess still extends across less than 180°. Furthermore, the width BS of the groove 8 will be slightly larger than the size BV of a side of the square pin 14-see FIG. 7.

During the assembly of a frame on a frame already standing vertically, the frame to be assembled is inserted in the horizontal position. The pins 14 of the succeeding posts 1 are inserted through the grooves 8 via the recesses 7 until the ends of the posts 1 come to rest against the walls of the bushings 5. When the pins 14 are fully inserted through the grooves 8, they engage the wall 11 of the groove while resting on wall 12 of the recess 7. This arrangement provides that the frame will not tilt downward when it is in the vertical position.

Figure 3:
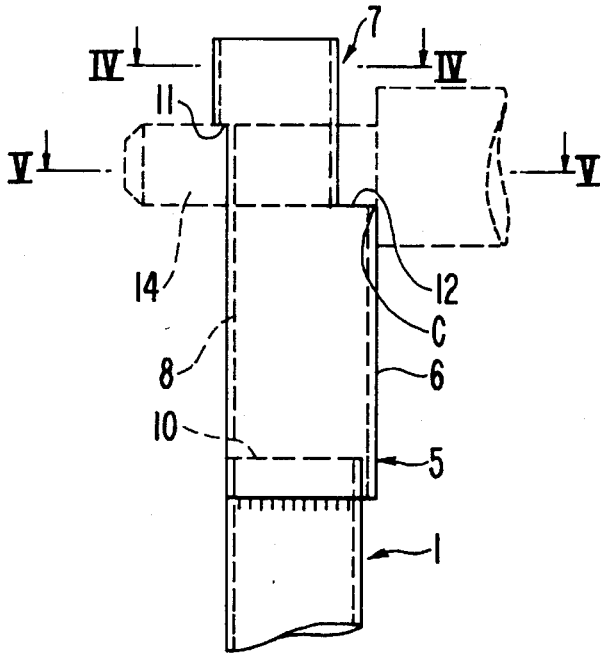
FIG. 3 depicts a side view of the detail of FIG. 2.
Figure 4:
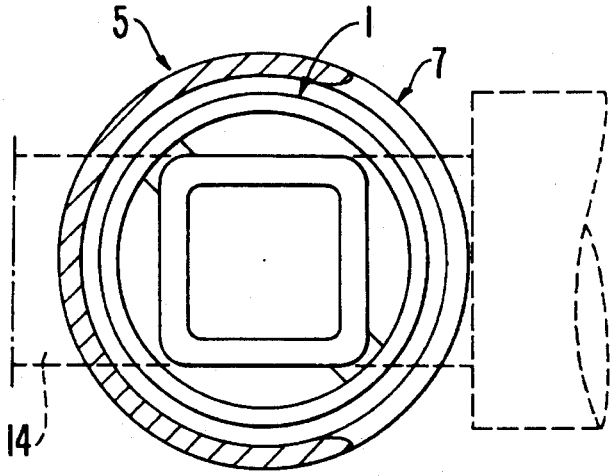
FIGS. 4 and 5 depict enlarged views of cross-sections along lines IV—IV, and lines V—V respectively, in which a post, which extends perpendicular to the depicted post, is indicated with dashes in FIG. 4.

A post of the frame to be assembled in the described position is indicated with dashes in FIGS. 3 and 4. The frame is swung from this position into the vertical position, during which the pins 14 move through the grooves 8, so that the frame is guided during the swing. When the frame is almost in the vertical position, then the posts 1 will fit into the bushings 5. Then the frame will lower due to its own weight, and the pins 14 will be received in the underlying posts 1.

To prevent the posts from being pulled out of the underlying posts, a bore 17, and a bore 18 respectively, can be provided in the upper ends 4 of each of the posts 1 and in the pins 14, in which a locking pin, not specified further, can be inserted.

It will be apparent that only a possible embodiment of a device according to the invention has been depicted in the drawings and specified above, and that numerous modifications can be brought about without departing from the spirit of the invention.

I claim:

1. A scaffolding construction for allowing two or more posts to be joined together in an aligned position, comprising:

a post having a first end and a second end;

a bushing positioned on the first end, a portion of the bushing protruding beyond the first end of the post;

a recess located in the protruding portion of the bushing, the recess having a bottom and being open at a top, and extending across a portion of a circumference of the protruding portion of the bushing; and a longitudinal groove having walls, a top and a bottom, the groove being formed in a wall of the protruding portion of the bushing opposite the recess, wherein the top of the groove is between the bottom of the recess and the end of the protruding portion of the bushing, and wherein the bottom of the groove is between the bottom of the recess and the post;

wherein the top of the groove and the bottom of the recess are spaced along the protruding portion of the bushing to 1) receive a pin of an additional post inserted through the recess and groove in a direction perpendicular to the longitudinal direction of the post and 2) guide the pin along the groove walls and support the pin by the recess when the additional post is swung into an aligned position with the post.

2. A scaffolding construction according to claim 1, further comprising a pin having a square cross-section joined to the second end of the post.

3. A scaffolding construction according to claim 1, wherein the bushing and first end of the post are annulus in cross-section and the inner diameter of the bushing is larger than the outer diameter of the first end of the post.

4. A scaffolding construction according to claim 1, wherein the portion of the circumference in which the recess extends is less than half the circumference.

5. A scaffolding construction according to claim 1, wherein the groove is formed along the length of the protruding portion of the bushing and the bottom of the groove is aligned with the first end of the post.

6. The scaffolding construction of claim 1, wherein the portion of the bushing that does not protrude beyond the first end of the post is fixed to the first end of the post by a weld.

7. The scaffolding construction of claim 1, wherein both the post and the pin of the additional post have a bore and a locking pin inserted in the bore of both the post and the pin of the additional post to lock them in the aligned position.

8. The scaffolding construction of claim 1, further comprising another post member identical to the post, connected to the post by a cross beam to form a H-shape frame.

9. A scaffolding construction for joining two or more posts in an aligned arrangement, comprising:

a post having a first end and second end;

a bushing provided on said first end of said post; and means for receiving a pin of an additional post inserted into said bushing and held in a direction perpendicular to the longitudinal direction of said post, and for guiding the pin of the additional post when the additional post is swung into an aligned position wherein said means comprises a recess having a bottom and being open at a top, and extending across a portion of a circumference of the bushing, and a longitudinal groove having a top and a bottom, the groove being formed in a wall of the bushing opposite the recess, wherein the top of the groove is between the bottom of the recess and the end of the bushing, and wherein the bottom of the groove is between the bottom of the recess and the post.

10. The scaffolding construction of claim 9, wherein said groove and recess are formed in a portion of said bushing that extends beyond said first end of said post.

11. The scaffolding construction of claim 9, wherein said recess is formed with walls that guide said pin of said additional post when it is swung, and said groove is formed with a wall for supporting said pin of said second post when it is swung.

12. The scaffolding construction of claim 9, further comprising a post pin provided on said second end of said post.

13. The scaffolding construction of claim 9, wherein said post pin on said second end of said post has a square cross-section.

14. The scaffolding construction of claim 9, wherein said first end of said post and said bushing are annulus in cross-section and the inner diameter of said bushing is larger than the outer diameter of said first end of said post.

15. The scaffolding construction of claim 14, wherein said recess is formed in less than half the circumference of said bushing and said groove formed along the longitudinal direction of said bushing opposite said recess.

16. The scaffolding construction of claim 9, said post has a bore to receive a locking pin that engages a bore in said pin of said additional post to lock said post and said additional post in the aligned position.

17. The scaffolding construction of claim 9, further comprising another post, identical to said post, to substantially form an H-shape frame with said post by a cross beam connected to both said post and said another post.

* * * * *